US009269296B2

(12) United States Patent
Pyon

(10) Patent No.: US 9,269,296 B2
(45) Date of Patent: Feb. 23, 2016

(54) PIXEL AND ORGANIC LIGHT EMITTING DISPLAY DEVICE USING THE SAME

(71) Applicant: Samsung Display Co., Ltd., Yongin, Gyeonggi-Do (KR)

(72) Inventor: Chang-Soo Pyon, Yongin (KR)

(73) Assignee: Samsung Display Co., Ltd., Giheung-Gu, Yongin-si, Gyeonggi-Do (KR)

( * ) Notice: Subject to any disclaimer, the term of this patent is extended or adjusted under 35 U.S.C. 154(b) by 172 days.

(21) Appl. No.: 13/959,410

(22) Filed: Aug. 5, 2013

(65) Prior Publication Data

US 2014/0292734 A1 Oct. 2, 2014

(30) Foreign Application Priority Data

Apr. 2, 2013 (KR) ..... 10-2013-0035919

(51) Int. Cl.
*G09G 3/32* (2006.01)

(52) U.S. Cl.
CPC ..... *G09G 3/3233* (2013.01); *G09G 2300/0819* (2013.01)

(58) Field of Classification Search
CPC ..... G09G 3/3233
See application file for complete search history.

(56) References Cited

U.S. PATENT DOCUMENTS 8,319,713 B2 11/2012 Choi
8,378,931 B2 2/2013 Kim et al.
8,378,933 B2 2/2013 Kwak et al.
8,384,632 B2 2/2013 Chiou
8,400,377 B2 3/2013 Hwang
8,432,342 B2 4/2013 Kim
8,436,850 B2 5/2013 Kim et al.
8,446,344 B2 5/2013 Choi
8,462,089 B2 6/2013 Han et al.
2007/0247398 A1* 10/2007 Nathan et al. ..... 345/82
2007/0279337 A1* 12/2007 Kim et al. ..... 345/76
2010/0141645 A1* 6/2010 Choi et al. ..... 345/214
2012/0105387 A1 5/2012 Choi
2012/0139961 A1 6/2012 Choi
2013/0002632 A1 1/2013 Choi
2013/0009933 A1 1/2013 Toyomura et al.
2013/0135275 A1 5/2013 Okuno et al.

FOREIGN PATENT DOCUMENTS

KR 10-2012-0044502 A 5/2012
KR 10-2012-0062252 A 6/2012

* cited by examiner

*Primary Examiner* — Dorothy Harris
(74) *Attorney, Agent, or Firm* — Robert E. Bushnell, Esq.

(57) ABSTRACT

A pixel according to the present invention includes: an organic light emitting diode having a cathode electrode connected to a second power; a first transistor controlling an amount of current supplied from a first power line connected through a third node to the organic light emitting diode connected through a second node in correspondence to the voltage applied to a first node; a storage capacitor connected between the first node and the second power; a second transistor connected between the first node and the third node and being turned on when a scan signal is supplied to a scan line; and a third transistor connected between the second node and the data line, and being turned on when the scan signal is supplied.

12 Claims, 3 Drawing Sheets

PIXEL AND ORGANIC LIGHT EMITTING DISPLAY DEVICE USING THE SAME

CLAIM OF PRIORITY

This application claims priority to and the benefit of Korean Patent Application No. 10-2013-0035919 filed on Apr. 2, 2013 in the Korean Intellectual Property Office, the entire content of which are incorporated herein by reference in their entirety.

BACKGROUND OF THE INVENTION

1. Field of the Invention

The present invention relates to a pixel and an organic light emitting display device using the same.

2. Description of the Related Art

Recently, various flat panel display devices capable of reduced weight and volume, which are disadvantages of a cathode ray tube, have been developed. As the flat panel display devices, there are a liquid crystal display, a field emission display, a plasma display panel, an organic light emitting display device, and the like.

Among the flat panel displays, the organic light emitting display device, which displays an image using an organic light emitting diode generating light by recombination between an electron and a hole, has advantages in that it has a rapid response speed and is driven at low power.

SUMMARY OF THE INVENTION

A pixel according to the exemplary embodiment of the present invention comprises: an organic light emitting diode including a cathode electrode coupled to a second power; a first transistor configured to control an amount of current supplied from a first power of a power line coupled through a third node to the organic light emitting diode coupled through a second node, corresponding to the voltage applied to a first node; a storage capacitor coupled between the first node and the second power; a second transistor coupled between the first node and the third node, the second transistor being turned on when a scan signal is supplied to a scan line; and a third transistor coupled between the second node and the data line, the third transistor being turned on when the scan signal is supplied.

The first power may be set to a low voltage for a part of a period during which the scan signal is supplied, and to a high voltage for a remaining part of the period. The pixel may further comprise a fourth transistor coupled between the third node and the power line, turned on for a part of a period during which the scan signal is supplied and turned off for a remaining part of the period, and a fifth transistor coupled between the second node and the organic light emitting diode, the fifth transistor being turned on and off at the same time as the fourth transistor.

An organic light emitting display device of an exemplary embodiment of the present invention may comprise: a scan driver configured to supply scan signals to scan lines and to supply emission control signals to emission control lines; a data driver configured to supply data signals to data lines; a first power driving unit configured to supply a first power to power lines in parallel with the scan lines; and pixels on the intersecting portion of the scan lines and the data liens; wherein each of the pixels on the i-th (i indicates a natural number) horizontal line includes an organic light emitting diode including a cathode electrode coupled to a second power, a first transistor configured to control an amount of current supplied from a i-th power line coupled through a third node to the organic light emitting diode coupled through a second node corresponding to the voltage applied to a first node, a storage capacitor configured to couple the first node and the second power, a second transistor configured to couple the first node and the third node and turned on when a scan signal is supplied to i-th scan line, and a third transistor configured to couple the second node and the data line and being turned on when the scan signal is supplied to the i-th scan line.

The first power driving unit supplies the first power as a low voltage for a first part of a period during which the scan signal is supplied to the i-th power line, and supplies the first power as a high voltage for a remaining part of the period.

The low voltage may be set to a voltage lower than that of the data signal, and the high voltage may be set to a voltage higher than that of the data signal.

The data driver may supply an initialization voltage to the data lines so as to be overlapped with the first power of the low voltage during a part of a period, and the data driver may supply the data signal so as to be overlapped with the scan signal supplied to the i-th scan line during a remaining part of the period.

The voltage value of initialization voltage may be set to turn off the organic light emitting diode.

The scan driver may supply an emission control signal to the i-th emission control line so as to be overlapped with the scan signal supplied to the i-th scan line during the remaining part of the period except the first part of the period. An organic light emitting display device of the embodiment of the present invention may further comprise a fourth transistor coupled between the third node and the power line, being turned off during a part of a period when the emission control signal is supplied to the i-th emission control line, and being turned on during a remaining part of the period, and a fifth transistor coupled between the second node and the organic light emitting diode and being turned on and off at the same time as the fourth transistor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

Figure 1:
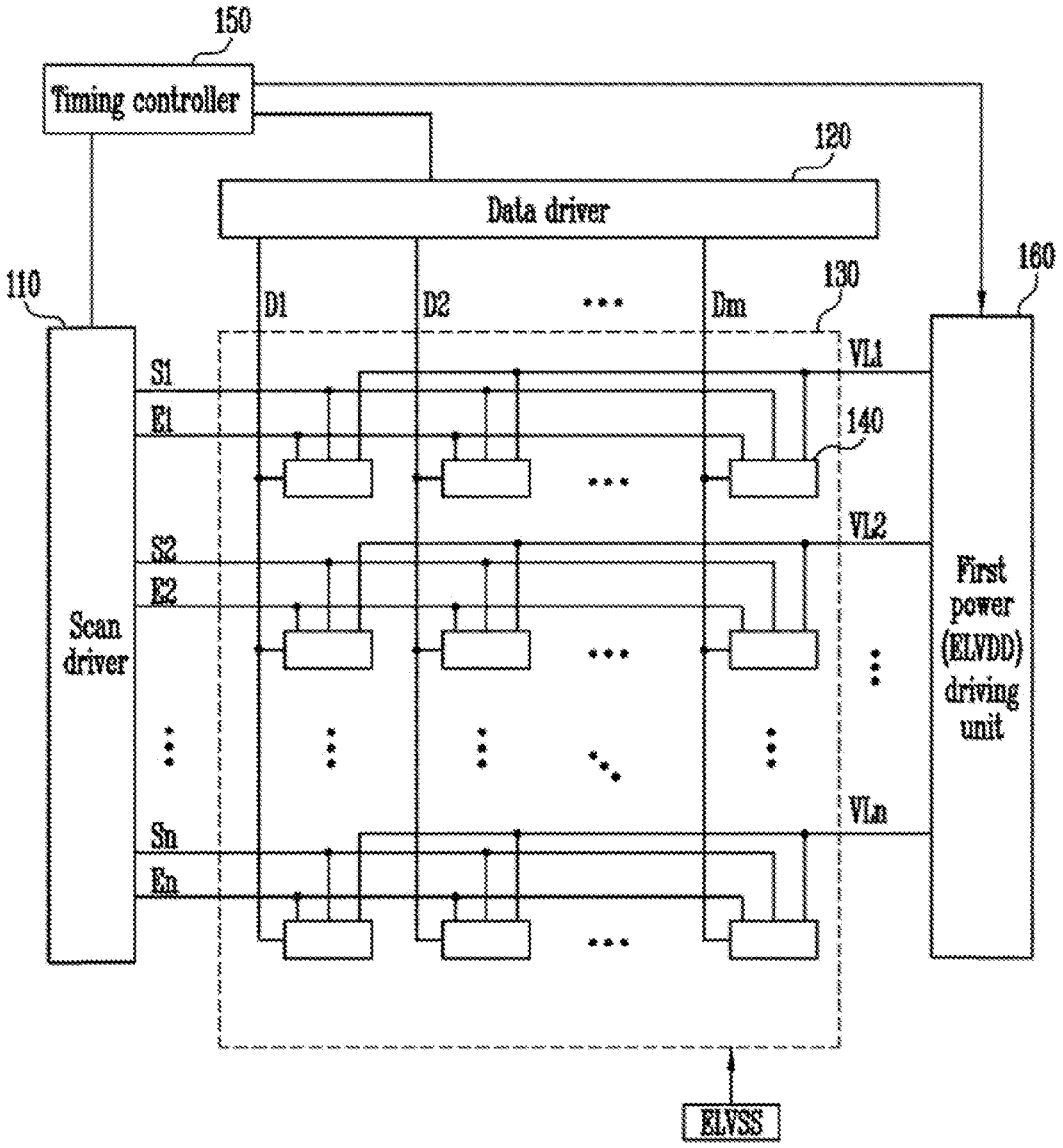
FIG. 1 is a view of an organic light emitting display device according to an exemplary embodiment of the present invention.

Exemplary embodiments will now be described more fully hereinafter with reference to the accompanying drawings, but they may be embodied in different forms and should not be construed as limited to the embodiments set forth herein. Rather, these embodiments are provided so that this disclosure will be thorough and complete, and will fully convey the scope of the exemplary embodiments to those skilled in the art.

In the drawing figures, dimensions may be exaggerated for clarity of illustration. It will be understood that, when an element is referred to as being "between" two elements, it can be the only element between the two elements, or one or more intervening elements may also be present. Like reference numerals refer to like elements throughout this specification.

DETAILED DESCRIPTION OF THE INVENTION

In the following detailed description, only certain exemplary embodiments of the present invention have been shown and described, simply by way of illustration. As those skilled in the art will realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the other element or be indirectly on the other element with one or more intervening elements interposed therebetween. Also, when an element is referred to as being "connected to" another element, it can be directly connected to the other element or be indirectly connected to the other element with one or more intervening elements interposed therebetween. Like reference numerals refer to like elements throughout this specification.

Hereinafter, exemplary embodiments of the present invention that may be easily practiced by those skilled in the art to which the present invention pertains will be described in detail with reference to FIGS. 1 to 3.

FIG. 1 is a view of an organic light emitting display device according to an exemplary embodiment of the present invention.

Referring to FIG. 1, the organic light emitting display device according to the exemplary embodiment of the present invention includes a pixel unit 130 including pixels 140 positioned at intersections between scan lines S1 to Sn and data lines D1 to Dm, a scan driver 110 driving the scan lines S1 to Sn and light emitting control lines E1 to En, a data driver 120 driving the data lines D1 to Dm, a first power driving unit 160 driving power lines VL1 to VLn, and a timing controller 150 controlling the drivers 110 and 120, and the driving unit 160.

The first power driving unit 160 supplies a first power ELVDD, which is repeatedly changed in low voltage and high voltage, to the power lines VL1 to VLn, respectively. For example, as shown in FIG. 3, the first driving unit 160 supplies a low voltage Vlow to the n power line VLn in some period when the scan signal is supplied to the n-th (n indicates a natural number) scan line Sn and supplies a high voltage Vhigh in another period. Here, the low voltage Vlow is set to a voltage lower than the data signal, and the high voltage Vhigh is set to a voltage higher than the data signal.

The scan driver 110 supplies the scan signals to the scan lines S1 to Sn and sequentially supplies the emission control signals to emission control lines E1 to En. Here, the scan driver 110 supplies the emission control signal to the n-th emission control line En so as to overlap the scan signal supplied to the n-th scan line Sn in some period. The emission control signal supplied to the n-th emission control line En is not overlapped with the low voltage Vlow supplied to the n-th power line VLn. Meanwhile, the scan signal is set to a voltage (for example, low voltage) capable of turning on the transistor included in each of the pixels 140, and the emission control signal is set to a voltage (for example, high voltage) capable of turning off the transistor included in each of the pixels 140.

The data driver 120 supplies an initialization power Vint and the data signal DS to the data lines D1 to Dm so as to synchronize the scan signals supplied to the scan lines S1 to Sn. For example, the data driver 120, in a period when the scan signal supplied during the low voltage Vlow is supplied to the power line VL, supplies an initialization power Vint to the data lines D1 to Dm, and the data signal DS is supplied in another period. Here, the voltage value of an initialization voltage Vint may be set such that an organic light emitting diode included in each of the pixels does not emit light.

The timing control unit 150 controls the scan driver 110, the data driver 120, and the control driving unit 160 according to synchronization signals supplied from outside.

A pixel unit 130 includes the pixels 140 disposed in matrix shape. Each of the pixels 140 is charged with a voltage corresponding to the data signal when the scan signals are supplied. In addition, each of the pixels 140 controls an amount of current supplied to the organic light diode and corresponding to the charged voltage, and generates a predetermined brightness light.

Figure 2:
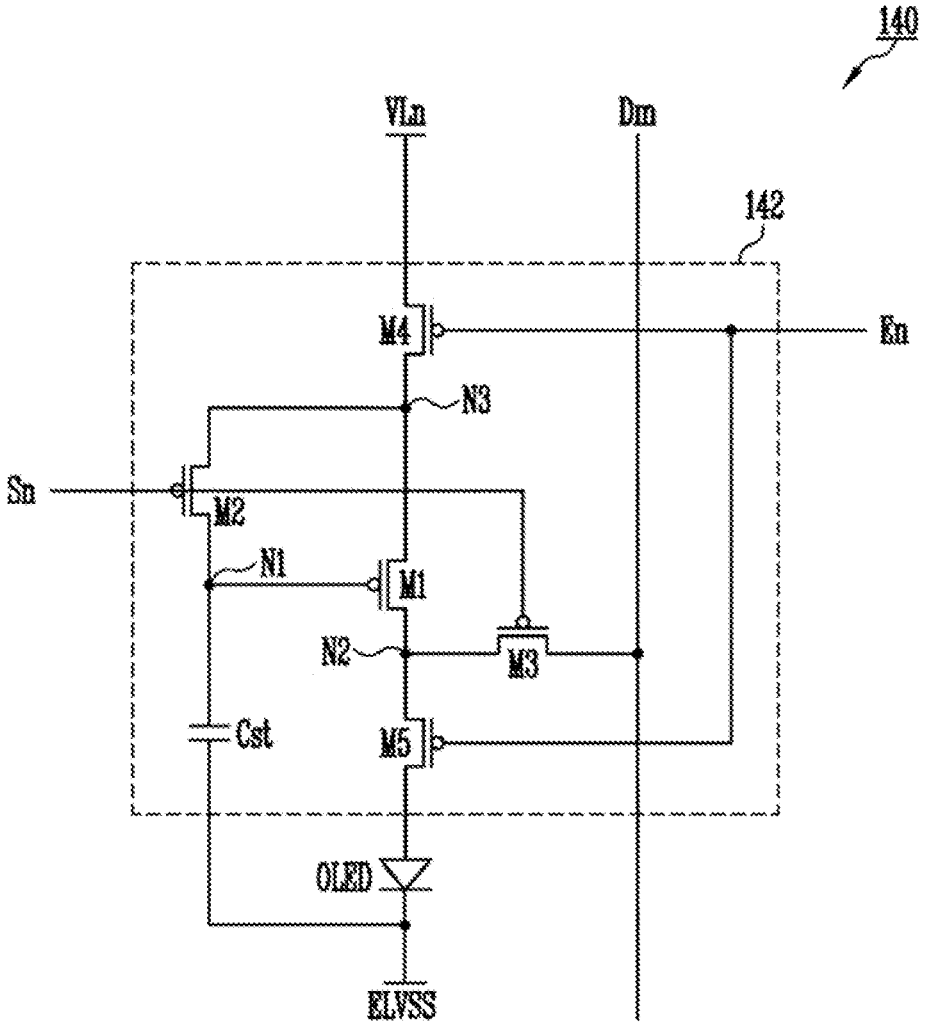
FIG. 2 is a view of a pixel according to the exemplary embodiment of the present invention.

FIG. 2 is a view showing a pixel according to the exemplary embodiment of the present invention. When FIG. 2 is described, the pixel connected to the n-th scan line (Sn) and an m-th data line (Dm) will be described for convenience of description.

Referring to FIG. 2, the pixel 140 according to the exemplary embodiment of the present invention includes an organic light emitting diode OLED and a pixel circuit 142 connected to the data line Dm and the scan line Sn for controlling an amount of current supplied to the organic light emitting diode OLED.

An anode electrode of the organic light emitting diode OLED is connected to the pixel circuit 142, and a cathode electrode thereof is connected to the second power ELVSS. The organic light emitting diode OLED, as described above, generates light having predetermined luminance and corresponding to an amount of current supplied from the pixel circuit 142.

The pixel circuit 142 receives data signals from the data lines Dm when the scan signals are supplied, and controls the amount of current supplied from the first power ELVDD of the high voltage Vhigh to the second power ELVSS through the organic light emitting diode OLED in correspondence to the data signal supplied. To this end, the pixel circuit 142 includes a first transistor M1 to a fifth transistor M5 and a storage capacitor Cst. Here, the second power ELVSS is set to be lower than that of the first power ELVDD of the high voltage Vhigh.

The storage capacitor Cst is connected between a first node N1 and the second power ELVSS. The storage capacitor Cst as described above is charged with the voltage corresponding to the threshold voltage and the data signals of the first transistor M1 (that is, a driving transistor).

A first electrode of the first transistor M1 is connected to the power line VLn through the third node N3, and the second electrode is connected to an anode electrode of the organic light emitting diode OLED through the second node N2. In addition, a gate electrode of the first transistor M1 is connected to the first node N1. The first transistor M1 controls the amount of current supplied to the organic light emitting diode OLED in correspondence to the voltage applied to the first node N1.

A first electrode of the second transistor M2 is connected to the third node N3, and a second electrode thereof is connected to the first node N1. In addition, a gate electrode of the second transistor M2 is connected to the scan line Sn. The second transistor M2, as described above, is turned on when the scan signal is supplied to scan line Sn, thereby electrically connecting the third node N3 and first node N1. In this case, the first transistor M1 is connected in diode shape.

A first electrode of the third transistor M3 is connected to the data line Dm, and a second electrode thereof is connected to the second node N2. In addition, a gate electrode of the third transistor M3 is connected to the scan line Sn. The third transistor M3 as described above is turned on when the scan signal is supplied to the scan line Sn, thereby electrically connecting the data line Dm to the second node N2.

The fourth transistor M4 is connected between the power line VLn and the third node N3. In addition, a gate electrode of the fourth transistor M4 is connected to the emission control line En. The fourth transistor M4 is turned off when the emission control signal is supplied to the emission control line En, and is turned on when the emission control signal is not supplied thereto.

The fifth transistor M5 is connected between the second node N2 and an anode electrode of the organic light emitting diode OLED. In addition, a gate electrode of the fifth transistor M5 is connected to the emission control line En. The fifth transistor M5 is turned off when the emission control signal is supplied to the emission control line En, and is turned on when the emission signal is not supplied thereto.

Figure 3:
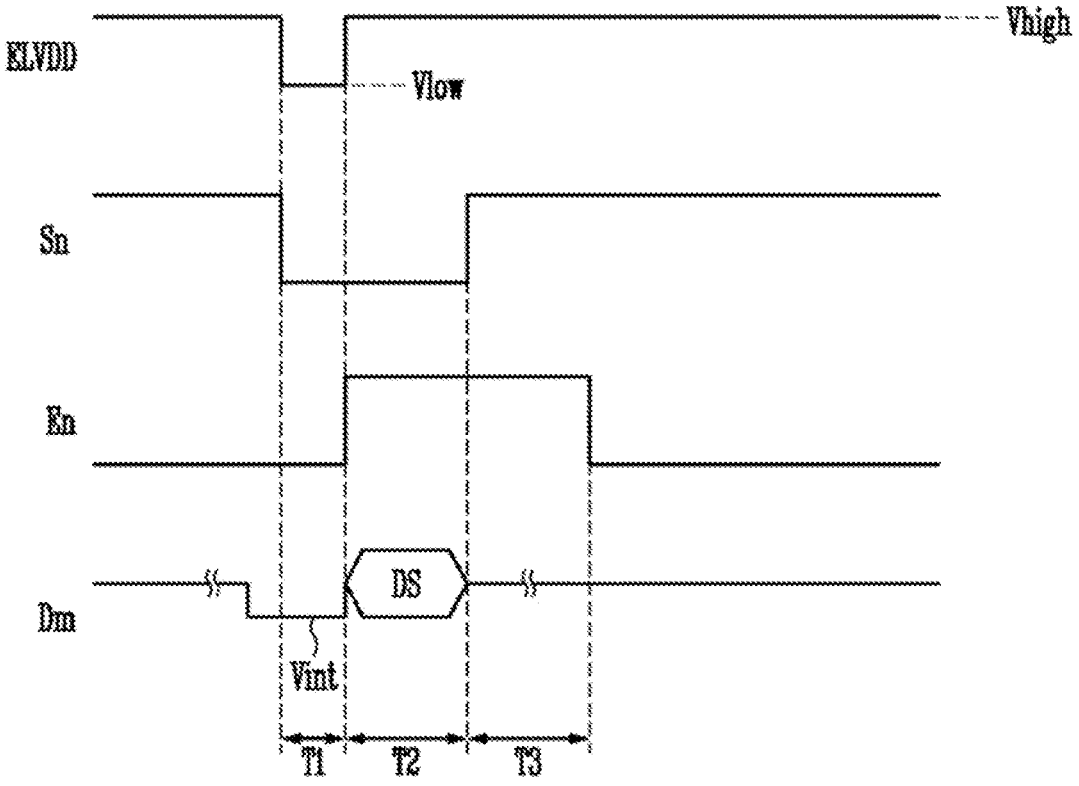
FIG. 3 is a waveform diagram of a driving method of the pixel shown in FIG. 2.

FIG. 3 is a waveform diagram showing a driving method of the pixel shown in FIG. 2.

Referring to FIGS. 2 and 3, first, the scan signal is supplied to the scan line Sn. In addition, in a first period T1 during which the scan signal is supplied to the scan line Sn, the initialization voltage Vint is supplied to the data Dm while the low voltage Vlow is supplied to the power line VLn.

When the scan signal is supplied to the scan line Sn, the second and third transistors M2 and M3 are turned on. When the third transistor M3 is turned on, the initialization voltage Vint from the data line Dm is supplied to the second node N2. When the initialization voltage Vint is supplied to the second node N2, the organic light emitting diode OLED is set to a non emission state.

When the second transistor M2 is turned on, the first node N1 is electrically connected to the power line VLn through the third node N3. Therefore, the low voltage Vlow from the power line VLn is supplied to the first node N1. That is, during the first period T1, the first node N1 is initialized as a low voltage Vlow lower than that of the data signal.

After that, in a second period T2 during which the scan signal is supplied to the scan line Sn, the emission control signal is supplied to the emission control line En while the data signal DS is supplied to the data line Dm. Also, the power line VLn receives the high voltage Vhigh during the second period T2.

When the emission control signal is supplied to the emission control line En, the fourth and fifth transistors M4 and M5, respectively, are turned off. When the fourth transistor M4 is turned off, the power line VLn and the third node N3 are not electrically connected to each other. When the fifth transistor M5 is turned off, the second node N2 and the organic light emitting diode OLED are not electrically connected to each other.

The data signal DS supplied to the data line Dm is supplied to the second node N2 during the second period T2. Here, since the first node N1 is initialized as a voltage lower than that of the data signal DS, the first transistor M1 connected in a diode shape is turned on. In this case, voltage of the second node N2 reduces a threshold voltage of the first transistor M1. Accordingly, during the second period T2, the voltage corresponding to the data signal and to the threshold voltage of the first transistor M1 is charged to the storage capacitor Cst.

Then, the scan signal supplied to the scan line Sn during the third period T3 is stopped, and the emission control signal is supplied to the emission control line En during the predetermined period. The third period T3 is a period when the pixel 140 is not emitting, the width thereof is controlled as needed.

After lapse of the predetermined third period T3, supply of the emission control signal to the emission control line En is stopped. When the emission control signal is stopped being supplied to the emission control line En, the fourth and fifth transistors M4 and M5, respectively, are turned on. When the fourth and fifth transistors M5 and M6, respectively, are turned on, a current path from the power line VLn to the organic light emitting diode OLED is formed. Here, the first transistor M1 controls an amount of current flowing from the first power ELVDD (that is, high voltage Vhigh), which is supplied to the power line VLn corresponding to the voltage charged to the storage capacitor Cst, to the organic light emitting diode OLED. Then, the organic light emitting diode OLED generates light having a predetermined brightness corresponding to an amount of current supplied from the first transistor M1.

In the foregoing present invention, there is an advantage in that the threshold voltages of the driving transistor M1 may be compensated using the pixel circuit 142 including the five transistors M1 to M5 and one capacitor Cst. In addition, in the present invention, there is an advantage in that a separate signal line is not added in order to initialize the gate electrode of the driving transistor M1, and therefore it is capable of being used for a high resolution panel.

Meanwhile, in the present invention, the transistors are shown as a P-channel metal oxide semiconductor (PMOS) for convenience of explanation, but the present invention is not limited thereto. In other words, the transistors may be formed as an N-channel metal oxide semiconductor (NMOS).

Also, in the present invention, the organic light emitting diode OLED generates red light, green light, or blue light corresponding to the amount of current supplied from the driving transistor, but the present invention is not limited thereto. For example, the organic light emitting diode (OLED) as described above generates white light corresponding to an amount of current supplied from the driving transistor. In this case, color image is implemented by using a separate color filter, or the like.

The organic light emitting display device includes a plurality of pixels arranged in a matrix form at intersections between a plurality of data lines and scan lines. The pixels generally include an organic light emitting diode, at least two transistors having a driving transistor, and at least one capacitor.

The organic light emitting display device has low power consumption. However, the amount of current flowing to the organic light emitting diode device is changed according to a deviation in threshold voltage between driving transistors included in each of the pixels, so that display non-uniformity may be generated. That is, a characteristic of the driving transistor may be changed according to a variable in the manufacturing process of a driving transistor provided to each of the pixels. Actually, at the present time, it is impossible to manufacture all of the transistors of the organic light emitting display device so as to have the same characteristics. Therefore, a deviation in threshold voltage of the driving transistor occurs.

In order to overcome the above-mentioned problem, a method of adding a compensation circuit, including a plurality of transistors and a capacitor, to each of the pixels has been proposed. The compensation circuit compensates for the deviation in a threshold voltage of the driving transistor by connecting the driving transistor in a diode form during a scan signal supply period. However, since the compensation circuit additionally connected to each pixel is connected to a plurality of the signal lines, it is difficult to apply to a high resolution panel.

As set forth above, in a pixel and the organic light emitting display device using the same according to the present invention, the threshold voltage of the driving transistor may be compensated using the pixel having a simple structure. In addition, in the present invention, a separate signal line is not added in order to initialize the gate electrode of the driving transistor, and therefore it is capable of being used for a high resolution panel.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising, an organic light emitting diode including a cathode electrode coupled to a second power line;

a first transistor configured to control an amount of current supplied from a first power line set to a low voltage for a first part of a period during which a scan signal is supplied, and to a high voltage for a remaining part of the period, to the organic light emitting diode in correspondence to a voltage applied to a first node, the first power line coupled through a third node to the first transistor coupled through a second node to the organic light emitting diode;

a storage capacitor coupled between the first node and the second power line;

a second transistor coupled between the first node and the third node, the second transistor being turned on when the scan signal is supplied to a scan line; and a third transistor directly coupled to the second node and the data line, the third transistor being turned on when the scan signal is supplied.

2. The pixel of claim 1, further comprising:

a fourth transistor coupled between the third node and the first power line, turned on for a part of a period during which the scan signal is supplied, and turned off for a remaining part of the period; and a fifth transistor coupled between the second node and the organic light emitting diode, the fifth transistor being turned on and off at the same time with the fourth transistor.

3. An organic light emitting display device, comprising:

a scan driver configured to supply scan signals to scan lines and to supply emission control signals to emission control lines;

a data driver configured to supply data signals to data lines;

a first power driving unit configured to supply a first power to a first power line in parallel with the scan lines; and pixels on the intersecting portion of the scan lines and the data lines;

wherein each of the pixels on the i-th (i indicates a natural number) horizontal line includes:

an organic light emitting diode including a cathode electrode coupled to a second power line;

a first transistor configured to control an amount of current supplied from an i-th power line to the organic light emitting diode in correspondence to a voltage applied to a first node, the i-th power line coupled through a third node to the first transistor coupled through a second node to the organic light emitting diode;

a storage capacitor configured to couple the first node and the second power line;

a second transistor configured to couple the first node and the third node, and being turned on when a scan signal is supplied to an i-th scan line; and a third transistor configured to directly couple the second node and the data line, and being turned on when the scan signal is supplied to the i-th scan line;

the first power driving unit supplying the first power as a low voltage for a first part of a period during which the scan signal is supplied to the i-th power line and supplying the first power as a high voltage for a remaining part of the period.

4. The organic light emitting display device of claim 3, the low voltage being set to a voltage lower than a voltage of the data signal, and the high voltage being set to a voltage higher than a voltage of the data signal.

5. The organic light emitting display device of claim 4, the data driver supplying an initialization voltage to the data lines so as to be overlapped with the first power of the low voltage during a part of a period, and the data driver supplying the data signal so as to be overlapped with the scan signal supplied to the i-th scan line during a remaining part of the period.

6. The organic light emitting display device of claim 5, the voltage value of the initialization voltage being set to turn off the organic light emitting diode.

7. The organic light emitting display device of claim 5, further comprising:

a fourth transistor coupled between the third node and one of the emission control lines, the i-th power line being turned off during a part of a period when the emission control signal is supplied to the i-th emission control line, and being turned on during a remaining part of the period, and a fifth transistor coupled between the second node and the organic light emitting diode and being turned on and off at the same time with the fourth transistor.

8. The organic light emitting display device of claim 3, the scan driver supplying an emission control signal to the i-th emission control line so as to be overlapped with the scan signal supplied to the i-th scan line during the remaining part of the period.

9. A pixel, comprising:

an organic light emitting diode including an anode electrode coupled to a power input;

a first transistor connected to the power input for controlling an amount of current supplied to the organic light emitting diode;

a storage capacitor directly coupled to a gate electrode of the first transistor and a cathode electrode of the organic light emitting diode;

a second transistor coupled to both the first transistor and the cathode electrode of the organic light emitting diode, said second transistor having a gate electrode and being responsive to a scan signal applied to the gate electrode for being turned on;

a third transistor connected to a data line, and connected to a scan line and the second transistor, said third transistor being responsive to the scan signal for being turned on; and a fourth transistor connected between the power input and the first transistor, and connected to an emission control line, said fourth transistor being responsive to an emission control signal received from the emission control line for being turned off, and said fourth transistor being responsive to absence of the emission control signal on the emission control line for being turned on.

10. The pixel of claim 9, further comprising:

a fifth transistor connected between the first transistor and the organic light emitting diode, and connected to the emission control line, said fifth transistor being responsive to the emission control signal received from the emission control line for being turned off, and said fifth transistor being responsive to absence of the emission control signal on the emission control line for being turned on.

11. The pixel of claim 10, the power input being set to a low voltage for a part of a period during which the scan signal is supplied, and to a high voltage for a remaining part of the period.

12. The pixel of claim 9, the power input being set to a low voltage for a part of a period during which the scan signal is supplied, and to a high voltage for a remaining part of the period.

* * * * *